US006627908B1

(12) United States Patent
Han et al.

(10) Patent No.: US 6,627,908 B1
(45) Date of Patent: Sep. 30, 2003

(54) RADIATION SOURCE ASSEMBLY AND CONNECTOR PRESS USED IN PRODUCING SUCH ASSEMBLIES

(75) Inventors: Hyon Soo Han, Taejon-si (KR); Woon Kap Cho, Taejon-si (KR); Soon Buk Hong, Taejon-si (KR); Kyeong Deuk Jang, Taejon-si (KR); Ul Jae Park, Taejon-si (KR)

(73) Assignee: Korea Atomic Energy Research Institute, Taejon-si (KR)

( * ) Notice: Subject to any disclaimer, the term of this patent is extended or adjusted under 35 U.S.C. 154(b) by 381 days.

(21) Appl. No.: 09/603,644

(22) Filed: Jun. 26, 2000

(30) Foreign Application Priority Data

Aug. 17, 1999 (KR) ..... UM 1999-16981
Aug. 17, 1999 (KR) ..... P 1999-33982
Aug. 17, 1999 (KR) ..... P1999-33983

(51) Int. Cl.[7] ..... G21G 4/00

(52) U.S. Cl. ..... 250/496.1; 250/493.1; 250/308; 378/119; 378/120; 378/65; 252/644; 252/645

(58) Field of Search ..... 250/493.1, 496.1, 250/308; 378/119, 120, 65; 252/644, 645

(56) References Cited

U.S. PATENT DOCUMENTS 4,827,493 A * 5/1989 Parsons et al. ..... 378/119

5,418,379 A * 5/1995 Parsons et al. ..... 250/497.1

* cited by examiner

*Primary Examiner*—John R. Lee
*Assistant Examiner*—David A. Vanore
(74) *Attorney, Agent, or Firm*—Bachman & LaPointe, P.C.

(57) ABSTRACT

A radiation source assembly and a connector press used in producing such assemblies. In the radiation source assembly, each of the cap connector and the female connector is provided with internal round threads on its pigtail fitting hole, thus engaging with the large-diameter coil of the pigtail at the internal round threads through a thread engagement prior to a compression process of the press. The assembly also allows a person to know whether both ends of the pigtail fully reach desired points within the two connectors, thus securing a precise compressing target portion during a compression process of the press. The inserted lengths of the pigtail relative to the two connectors are maximize accomplishing a desired linearity of the assembly. In the assembly, a target biasing spring is provided on the capsule lid and allows the disc targets within the source capsule to effectively maintain a desired condition as point sources regardless of the number of targets. The connector press of this invention accomplishes a desired compression locking of the source capsule to the pigtail by simultaneously compressing the capsule at regularly and angularly spaced points through a multi-point compressing process, thus accomplishing a desired linearity of the radiation source assembly.

5 Claims, 10 Drawing Sheets

RADIATION SOURCE ASSEMBLY AND CONNECTOR PRESS USED IN PRODUCING SUCH ASSEMBLIES

BACKGROUND OF THE INVENTION

1. Field of the Invention

The present invention relates, in general, to a radiation source assembly used in a nondestructive inspection process and a connector press used in producing such assemblies and, more particularly, to an Ir-192 radiation source assembly, with a source capsule having double-sealed radiation source discs and two connectors, or a cap connector and a female connector being respectively coupled to both ends of a pigtail, and to a connector press used for compression-connecting the two connectors to both ends of such a pigtail so as to form a desired radiation source assembly.

2. Description of the Prior Art

In order to produce a radiation source used in a nondestructive inspection, a plurality of Ir-radiation source discs have been conventionally used. Some countries import radiation source disc targets from foreign countries. Such disc targets are primarily processed products, and so they must be pre-processed and finally processed before they are exposed to neutrons within a nuclear reactor. A conventional pre-process and a conventional final process for the disc targets will be described as follows.

Primarily, both diameter and thickness of such a disc target are measured prior to inspecting any external defect of the disc target with the naked eye. Sometimes, such a naked eye inspection may discover a defect on one surface of a disc target.

Thereafter, the flatness of the disc target is measured. Since conventional radiation source disc targets are typically produced through a punching process, the disc targets fail to have a desired flatness. Therefore, it is necessary to flatten the radiation source disc target with a nonmetal hammer while interposing the disc target between two flat metal discs. When the radiation source disc target fails to accomplish a desired flatness, it is almost impossible for the disc target to perform a desired operational performance of a point source or to provide a high quality nondestructive inspection image.

It is also necessary to completely remove micro debris from the surface of the radiation source disc target since such micro debris may cause a radioactive contamination.

After the pre-process, the radiation source disc target is washed using neutral detergent and distilled water, and is finally ultrasonically washed prior to being dried, thus completely preparing a desired radiation source disc target. The dimension of the disc target is measured and is compared with calculated values. The prepared disc target is an Ir-metal type disc having a diameter of 2.5 mm, a thickness of 0.25 mm, a weight of 27.6 mg/disc, a nuclidic purity of 99.9%, and a specific weight of 22.5 g/cm$^3$.

After preparing the radiation source disc targets and manufacturing a radiation source capsule, a desired radiation source is produced. In order to produce a desired radiation source, a plurality of disc targets, enclosed within an aluminum irradiation container, are exposed to neutrons within a neutron irradiation hole of a multi-purpose nuclear reactor for a predetermined period of time. After the neutron irradiation process, the irradiation container is removed from the neutron irradiation hole of the nuclear reactor and is received within a carrier vessel, and is moved to a concrete hot cell along with the vessel. Within the concrete hot cell, the irradiation container is removed from the carrier vessel by a manipulator. The irradiation container is, thereafter, set in automatic classifying and measuring equipment. When a control unit of the equipment is turned on, the container is automatically processed through a container cutting process, a radioactivity measuring process, and a classified radiation source capsuling process in accordance with a program of the control unit. In such a case, the Ir-disc targets from the radioactivity measuring process are received within a stainless capsule in a way such that 5 to 10 disc targets are received within each capsule. The stainless capsule is, thereafter, closed by a lid prior to being welded into a single structure at the junction between the capsule and the lid through a plasma arc welding process, thus forming a sealed radiation source.

When such a radiation source capsule is completely produced, a desired radiation source assembly is produced. An example of conventional radiation source assemblies is shown in the accompanying drawing, FIG. 1.

As shown in the drawing, the radiation source assembly 1 comprises a source capsule 3, a female connector 5 and a pigtail 7. In such a case, the source capsule 3 is made of SUS 316L, and consists of a cap connector 9, an outside cap 11 and an inside capsule 13. As best seen in FIG. 2, the cap connector 9 receives one end of the pigtail 7, while the outside cap 11 is welded to the cap connector 9 through a TIG welding process. The inside capsule 13 is set within the outside cap 11.

In order to receive the inside capsule 13, the outside cap 11 has a cavity. The above cap 11 also has an arcuate cross-section, with the tip of the cap 11 being rounded. The object of such a rounded tip of the cap 11 is to minimize a kinetic resistance generated at the tip when the radiation source assembly passes through guide tube of a nondestructive inspection apparatus. The inside cap 11 is fitted over a connecting projection 31 of the cap connector 9 at its fitting opening prior to being integrated with the connector 9 into a single structure through a TIG welding process.

The cap connector 9, connected to the pigtail 7, is a cylindrical member provided with a pigtail fitting hole 15. The connecting projection 31 is provided on an end of the cap connector 9 opposite to the pigtail fitting hole 15.

As shown in FIG. 3, the inside capsule 13, set within the outside cap 11, consists of a cylindrical outside case 14, a sealing cover 16 and a filler 17. The outside case 14 receives a plurality of radiation source disc targets 10 in a way such that the targets 10 are regularly stacked. The sealing cover 16 is fitted into the top open end of the outside case 14, thus sealing the outside case 14. The filler 17 is interposed between the sealing cover 16 and the stacked targets 10 so as to press the targets 10.

As best seen in FIGS. 4*a* and 4*b*, the pigtail 7 consists of a wire core 23, a primary coil 25, a secondary coil 27, and a large-diameter coil 29. The wire core 23 is made by twisting a plurality of wires 21, the primary coil 25 is wound around the wire core 23. The secondary coil 27 is wound around the primary coil 25. The large-diameter coil 29, having a predetermined regular pitch, is wound around the primary coil 25 along with the secondary coil 27. In such a case, all the wires and coils of the pigtail 7 are made of carbon steel, and so they have a predetermined elasticity. The wires and coils of the pigtail 7 are not undesirably wear-cut or loosened even though the pigtail 7 is used ten thousand or more times. The wires and coils are also free from corrosion even when they are exposed to atmospheric air.

The above radiation source assembly 1 passes through a guide tube under the control of a manipulation handle connected to a male connector engaging with the female connector 5 of the assembly 1. The assembly 1 is thus finally received within a radiation source carrier. Such an assembly 1 enclosed by the radiation source carrier is used with a nondestructive inspection apparatus. During a nondestructive inspecting operation, the assembly 1 reaches an inspection point by the guide tube. When the radiation source assembly 1 is kept within the radiation source carrier, a stop ball 19, formed on one end of the female connector 5 positioned at the rear end of the assembly 1 as shown in FIG. 5, is locked to an inside wall of the carrier, thus being firmly and precisely positioned within the carrier. This finally completely prevents a radiation leakage, caused by an assembly 1 failing to be precisely positioned within the carrier.

In the conventional radiation source assembly 1, the source capsule 3 and the female connector 5 are locked to both ends of the pigtail 7 through a compressing process. That is, as shown in FIGS. 2 and 5, both ends of the pigtail 7 are primarily fitted into the first pigtail fitting hole 15 of the cap connector 9 of the source capsule 3 and the second pigtail fitting hole 18 of the female connector 5, respectively. Thereafter, the female connector 5 and the cap connector 9 are inwardly compressed in a radial direction using a dedicated connector press until the two connectors 5 and 9 are locked to both ends of the pigtail 7. However, the conventional radiation source assembly 1 is problematic in that the two connectors 5 and 9 may be unexpectedly removed from both ends of the pigtail 7 during an operation of the assembly 1.

In addition, when the two connectors 5 and 9 are fitted over both ends of the pigtail 7, the ends of the pigtail 7 may fail to completely reach the inside ends of the fitting holes 15 and 18 of the two connectors 9 and 5 in accordance with the linearity of the pigtail 7, the flatness and linearity of the fitting holes 15 and 18 of the two connectors 9 and 5, and/or the pressure applied to the source capsule 3 and the female connector 5 while fitting the capsule 3 and female connector 5 over both ends of the pigtail 7. It is thus almost impossible to assure desired positions of both ends of the pigtail 7 within the two connectors 5 and 9 prior to compressing the two connectors 5 and 9 over the pigtail 7. Furthermore, the inserted lengths of the pigtail 7 within the two connectors 5 and 9 are not sufficient to provide a desired linearity of the assembly 1 after the connectors 5 and 9 are compression-locked to both ends of the pigtail 7.

In the above radiation source assembly 1, the outside case 14 of the inside capsule 13 is closed by and welded to a sealing cover 16 while accomplishing a desired sealing effect, with the disc targets 10 and the filler 17 being set within the outside case 14. When the number and/or thickness of the stacked disc targets 10 does not agree with the length of the filler 17, the disc targets 10 may slip on each other or may be separated from each other within the outside case 14. In such a case, the disc targets 10, or the point sources of a radiography, may be movable during a nondestructive inspecting operation of the assembly 1, thus failing to provide a clear image and to provide precise nondestructive inspecting results.

On the other hand, the cap connector 9 of the source capsule 3 is welded to the pigtail 7 through a TIG welding process. However, the materials of both the capsule 3 and the pigtail 7 may be undesirably changed in their physical characteristics due to heat generated during the TIG welding process, thus causing a thermal defect and a thermal deterioration at the welded junction between the cap connector 9 and the pigtail 7. In an effort to overcome such a thermal defect and such a thermal deterioration at the welded junction between the cap connector 9 and the pigtail 7, the cap connector 9 may be locked to the pigtail 7 through a compression process rather than the welding process.

As shown in FIG. 6, such a compression process of locking the cap connector 9 to the pigtail 7 uses a dedicated connector press 51. The conventional connector press 51 compresses the cap connector 9 of the source capsule 3 with the pigtail 7 being fitted into the cap connector 9, thus locking the capsule 3 to the pigtail 7 and making a desired radiation source assembly. In such a case, the target portion to be compressed is the overlapped portion of the cap connector 9 engaging with the pigtail 7.

When the cap connector 9 of the capsule 3 is compression-locked to the pigtail 7 using the press 51 consisting of top and bottom dies 53 and 55 as shown in FIG. 6, there is a deviation of the compression force in an axial direction of the pigtail 7, with the compression force being applied to the overlapped portion of the cap connector 9 engaging with the pigtail 7, even though the compression force is uniformly distributed on the overlapped portion in a vertical direction. Therefore, it is almost impossible for a resulting assembly 1 to have a desired linearity.

The radiation source assembly 1 failing to have such a desired linearity does not accomplish required conditions of assemblies. Such an assembly 1 may be also excessively abraded when it repeatedly moves within the guide tube in opposite directions, and so the assembly 1, having a dangerous radioactive material, may fail to accomplish a desired degree of operational safety and may cause a radioactive contamination.

SUMMARY OF THE INVENTION

Accordingly, the present invention has been made keeping in mind the above problems occurring in the prior art, and an object of the present invention is to provide a radiation source assembly, of which each of the cap connector and the female connector is provided with internal round threads on its pigtail fitting hole, thus engaging with the large-diameter coil of the pigtail at the internal round threads through a thread engagement prior to a compression process and being almost completely prevented from an unexpected removal from the pigtail, which allows a person to know whether both ends of the pigtail fully reach desired points within the two connectors, thus securing a precise compressing target portion, and of which the inserted lengths of the pigtail relative to the two connectors are maximized, thus accomplishing a desired linearity of the assembly.

Another object of the present invention is to provide a radiation source assembly, which is provided with a target biasing spring on the capsule lid for allowing the disc targets within the source capsule to effectively maintain a desired condition as point sources regardless of the number of targets, with a capsule lid biasing device being provided on a dedicated welding jig for allowing the capsule lid to be welded to a capsule body while maintaining the disc targets in the states of point sources and improving the weldability of an inside capsule of the source capsule.

A further object of the present invention is to provide a connector press used in producing the radiation source assemblies, which accomplishes a desired compression locking of the source capsule to the elastic pigtail by simultaneously compressing the capsule at regularly and angularly spaced points through a multi-point compressing process, and which thus accomplishes a desired linearity of the capsule and the pigtail, and prevents the capsule from causing an operational error or being abrasion-damaged due to a frictional resistance generated at the capsule when the capsule repeatedly moves within a guide tube in opposite directions.

The above-mentioned primary object of this invention is accomplished by a radiation source assembly, comprising a source capsule enclosing a radiation source, a female connector connected to a male connector coupled to a manipulation handle, and a pigtail connecting the source capsule and the female connector together, wherein a cap connector of the source capsule has first internal threads on its pigtail fitting hole, with the first internal threads having a profile corresponding to a large-diameter coil of the pigtail and engaging with the large-diameter coil of a first end of the pigtail through a thread engagement.

In the above assembly, the female connector has second internal threads on its pigtail fitting hole, with the second internal threads having a profile corresponding to the large-diameter coil of the pigtail and engaging with the large-diameter coil of a second end of the pigtail through a thread engagement. The number of each of the first and second internal threads is four or more.

The above-mentioned second object of the present invention is accomplished by a radiation source assembly, comprising: a capsule body receiving stacked radiation source disc targets; a capsule lid fitted into an open end of the capsule body and welded to the capsule body, thus sealing the capsule body; and a coil spring set within a spring seat hole of the capsule lid and adapted to normally bias the radiation source disc targets within the capsule body in a direction after the capsule lid is welded to the capsule body.

The above-mentioned third object of the present invention is accomplished by a connector press for producing a radiation source assembly by compression-locking a source capsule to a first end of a pigtail of the assembly, with the source capsule being fitted over the first end of the pigtail prior to a compression-locking process of the press, comprising: a plurality of compression punches radially arranged on a holding disc at regularly and angularly spaced positions to compress an overlapped portion of the source capsule fitted over the pigtail at regularly and angularly spaced external points; a plurality of pressure rods hinged to an edge of a support at regularly and angularly spaced positions and adapted to respectively and inwardly push the compression punches in a radial direction of the holding disc at outside ends of the punches; and a reciprocable push rod being movable in opposite directions in cooperation with a cylinder actuator so as to synchronously rotate the pressure rods around hinge points of the pressure rods, thus allowing the pressure rods to be opened or closed at their punch pushing ends and to selectively push the compression punches inwardly in the radial direction of the holding disc.

In the above connector press, each of the compression punches is movably received within a radial guide member of the holding disc, thus being radially reciprocable on the holding disc under the guide of the guide member, with a compression tip having a radius of curvature equal to a desired compressed radius of the source capsule and being removably attached to an inside end of each compression punch, and a return spring connecting each of the compression punches to the holding disc so as to elastically return each compression punch to its original position within the guide member when an external force is removed from each compression punch.

In addition, each of the pressure rods is provided with a roller at an end opposite to its punch pushing end. On the other hand, the push rod is provided with a truncated conical push block at an outside end thereof, the push block having an inclined surface due to its truncated conical shape, with rollers of the pressure rods being brought into rotatable contact with the inclined surface of the push block, thus allowing the pressure rods to be synchronously closed at their punch pushing ends when the push rod is moved toward the support of the pressure rods by a driving force of the cylinder actuator.

The above connector press further comprises: a scale rod movably inserted at a center of the support and adapted for supporting a tip of the source capsule; and an adjusting screw radially and movably threaded into the support from the outside to the center of the support and adapted for holding or releasing the scale rod within the center of the support.

BRIEF DESCRIPTION OF THE DRAWINGS

The above and other objects, features and other advantages of the present invention will be more clearly understood from the following detailed description taken in conjunction with the accompanying drawings, in which:

FIGS. 4*a* and 4*b* are views of the pigtail included in the conventional assembly of FIGS. 1 and 2, in which FIG. 4*a* is a front view showing the profile of the pigtail, and FIG. 4*b* is a sectional view of the diameters of core and coils of the pigtail;

DESCRIPTION OF THE PREFERRED EMBODIMENTS

Figure 7:
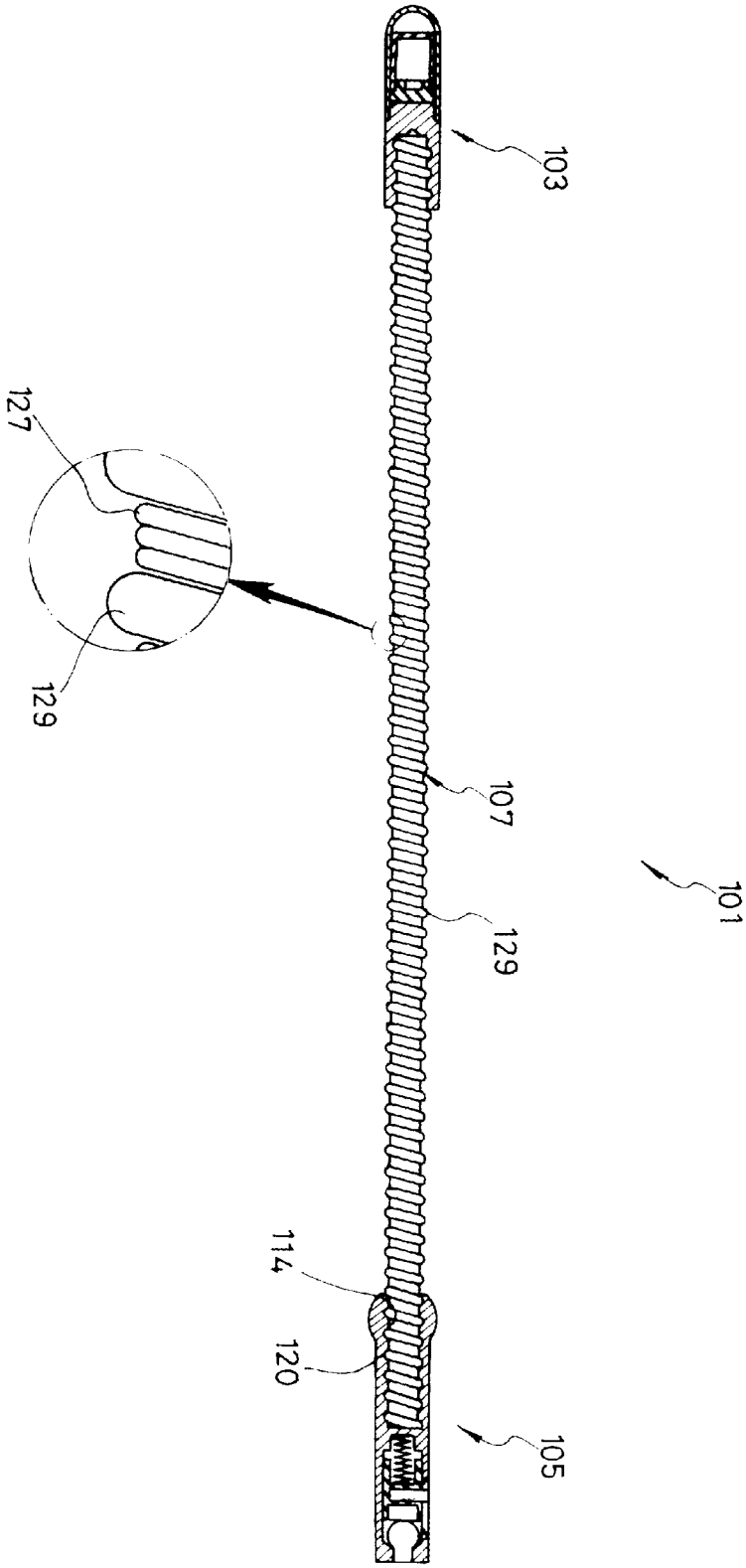
FIG. 7 is a front view of a radiation source assembly in accordance with the preferred embodiment of the present invention.

FIG. 7 is a front view of a radiation source assembly in accordance with the preferred embodiment of the present invention. As shown in the drawing, the radiation source assembly 101 comprises a pigtail 107, with a source capsule 103 and a female connector 105 respectively connected to both ends of the pigtail 107.

Figure 1:
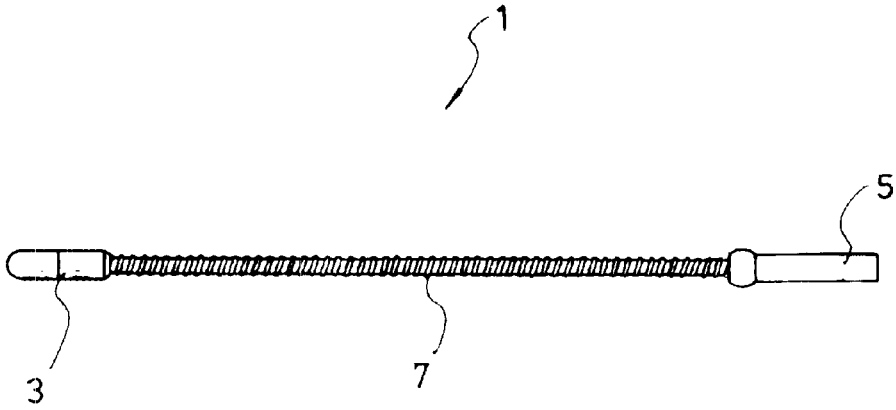
FIG. 1 is a front view of a conventional radiation source assembly.
Figure 2:
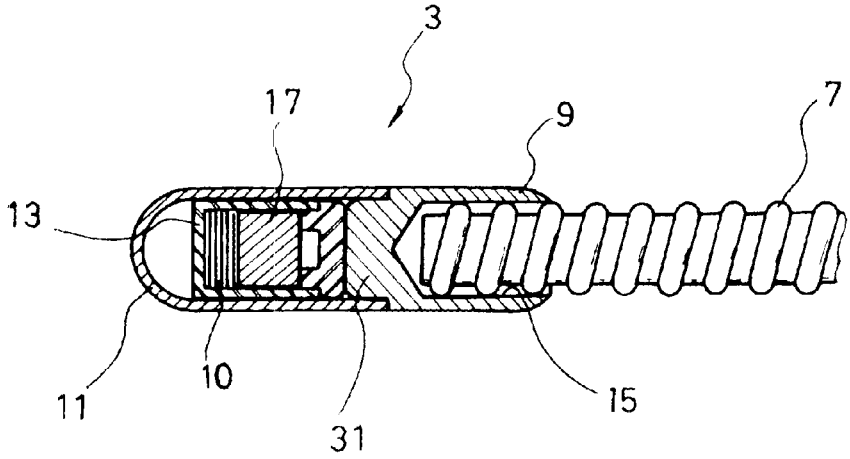
FIG. 2 is a sectional view, showing the construction of a source capsule connected to one end of a pigtail of the conventional assembly shown in FIG. 1.
Figure 3:
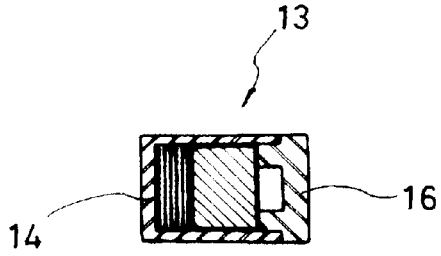
FIG. 3 is a sectional view, showing the construction of an inside capsule of the source capsule shown in FIG. 2.
Figure 4A:
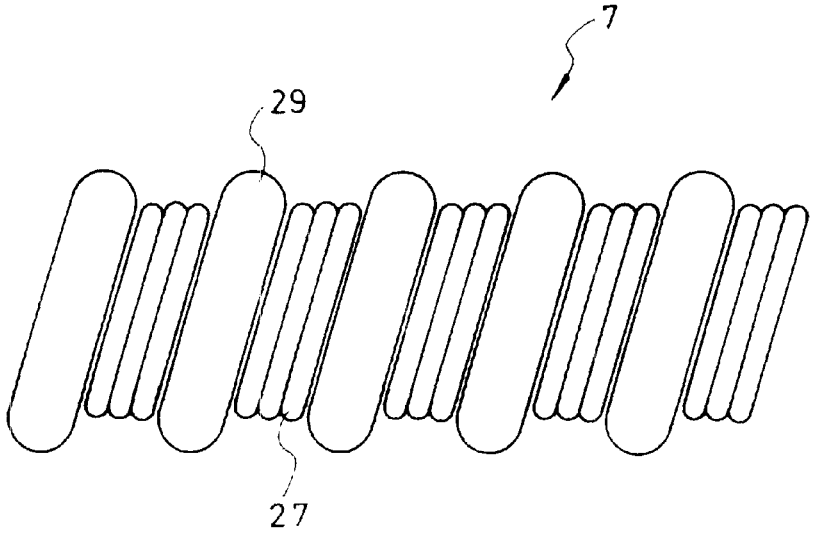
Figure 4B:
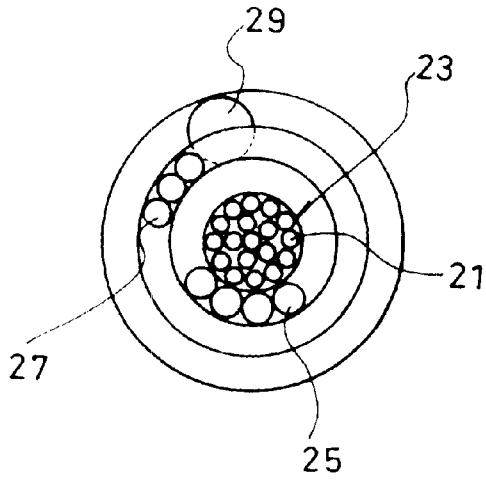
Figure 5:
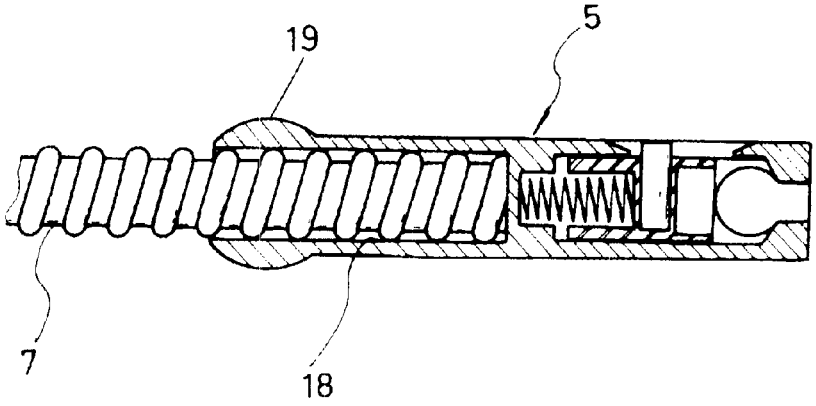
FIG. 5 is a sectional view, showing the construction of a female connector connected to the other end of the pigtail of the conventional assembly shown in FIG. 1.
Figure 6:
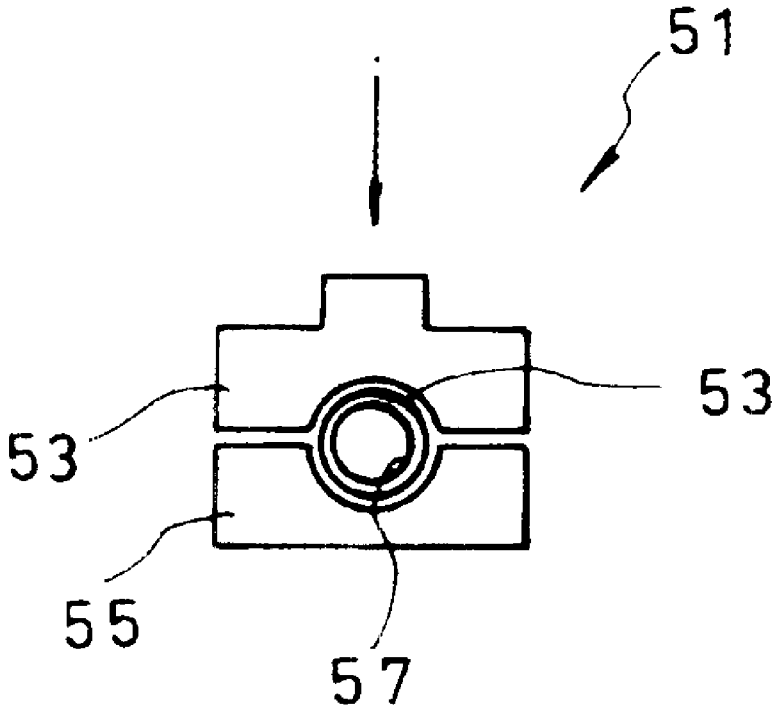
FIG. 6 is a front view, schematically showing the construction of a conventional press used for compression-locking the cap connector of the source capsule to the pigtail of the assembly of FIG. 2.

In the assembly 101 of this invention, the pigtail 107 has the same construction as that of the conventional pigtail 7 of FIGS. 4*a* and 4*b*. That is, the pigtail 107 is an elastic rod having a round thread profile and consisting of a wire core made by twisting a plurality of carbon steel wires. A primary coil is wound around the wire core, while a secondary coil 127 is wound around the primary coil. A large-diameter coil 129, having a predetermined regular pitch, is wound around the primary coil along with the secondary coil 127. The above pigtail 107 is made of carbon steel, and so the pigtail 107 is not undesirably wear-cut or loosened even though it is used a great number of times in the same manner as that described for the conventional pigtail 7. The pigtail 107 is also free from corrosion even when its is exposed to atmospheric air.

On the other hand, the source capsule 103, connected to a first end of the pigtail 107, consists of a cap connector 109, an outside cap 111 and an inside capsule 113. The cap connector 109, connected to the pigtail 107, is a cylindrical member provided with a pigtail fitting hole 115 for receiving the first end of the pigtail 107. A connecting projection 131 is provided on an end of the cap connector 109 opposite to the pigtail fitting hole 115, with the outside cap 111 being fitted over the connecting projection 131 at its fitting opening.

Figure 8:
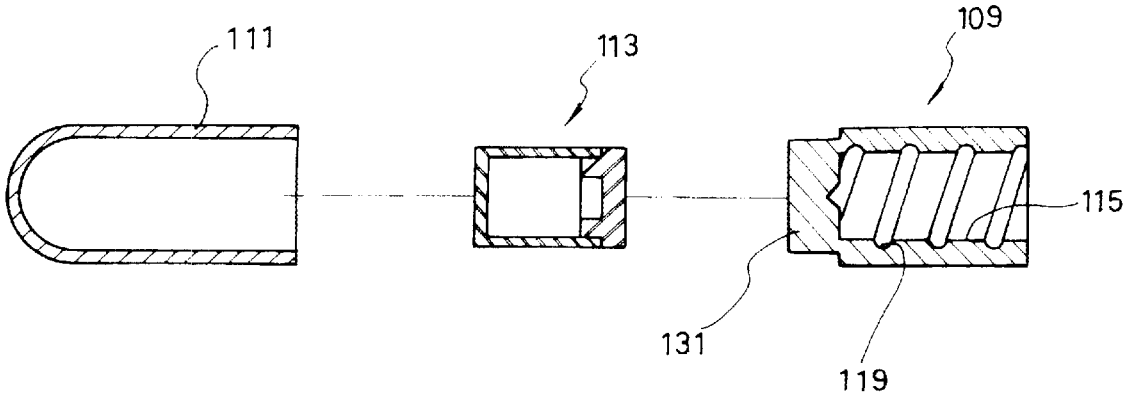
FIG. 8 is an exploded sectional view, showing the construction of a source capsule included in the assembly of FIG. 7.

In the assembly 101 of this invention, the pigtail 107 has a round thread profile as described above, with the large-diameter coil 129 forming screw threads. In order to allow the cap connector 109 of the source capsule 103 to engage with the first end of the pigtail 107 through a thread engagement, the connector 109 has internal round threads 119 on the pigtail fitting hole 115, with the threads 119 having a profile corresponding to the large-diameter coil 129 of the pigtail 107. In the preferred embodiment of FIG. 8, four internal round threads 119 are formed on the inside wall of the pigtail fitting hole 115 of the cap connector 109, thus engaging with four screw threads of the large-diameter coil 129 of the pigtail 107. In the preferred embodiment, the number of internal round threads 119 formed on the pigtail fitting hole 115, or four, is determined as an example since the four threads 119 are the minimum number of threads which can accomplish a desired linearity of the pigtail 107 with the cap connector 109 compression-locked to the pigtail 107. Therefore, it should be understood that four or more internal round threads 119 may be formed on the inside wall of the cap connector 109 without affecting the functioning of this invention if the number of threads 119 is not restricted by a variety of nuclear equipment standards.

In order to receive the inside capsule 113, the outside cap 111 has a cavity. The inside cap 111 also has an arcuate cross-section, with the tip of the cap 111 being rounded. The object of such a rounded tip of the cap 111 is to minimize a kinetic resistance generated at the tip when the radiation source assembly 101 passes through the guide tube of a nondestructive inspection apparatus. The inside cap 111 is fitted over the connecting projection 131 of the cap connector 109 at its fitting opening prior to being integrated with the connector 109 into a single structure through a TIG welding process.

Figure 9:
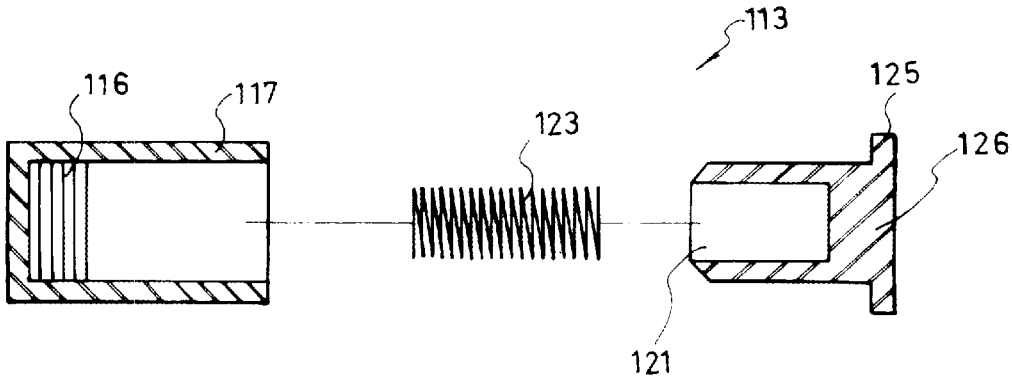
FIG. 9 is an exploded sectional view, showing the construction of an inside capsule of the source capsule shown in FIG. 7.

In such a case, the inside capsule 113 is made of SUS 316L, and has a side length of at least 0.5 cm in order to meet the requirement disclosed in the enforcement regulations of atomic energy law. As shown in FIG. 9, the inside capsule 113, set within the outside cap 111, consists of a cylindrical capsule body 117 receiving stacked disc targets 116. A capsule lid 126 is fitted into the open end of the capsule body 117 prior to being welded to the body 117, thus sealing the capsule body 117. A coil spring 123 is set within a spring seat hole 121 of the capsule lid 126 and normally biases the disc targets 116 in a direction when the capsule lid 126 is integrated with the capsule body 117 through a welding process.

The above capsule body 117 is a hollow cylindrical body, which receives the disc targets 116 therein and is open at one end thereof so as to engage with the capsule lid 126 at the open end. The capsule body 117 has an outer diameter, which allows the body 117 to be closely fitted into the outside cap 111, and has an inner diameter which is slightly larger than the diameter of the disc targets 116 so as to allow the targets 116 to be movable within the capsule body 117. The capsule lid 126, closing the capsule body 117, is a cylindrical member having an outer diameter slightly smaller than the inner diameter of the capsule body 117. The capsule lid 126 also has a flange 125 at its outside end, with the spring seat hole 121 for the target biasing spring 123 being concentrically formed at the inside end of the lid 126. Prior to a welding process of integrating the capsule lid 126 with the capsule body 117, the capsule lid 126 is fully fitted into the open end of the capsule body 117 with the flange 125 coming into close contact with the edge of the open end of the capsule body 117.

When the capsule lid 126 is welded to the capsule body 117, a dedicated welding jig is used. In order to weld the capsule lid 126 to the capsule body 117, a plurality of stacked disc targets 116 are set within the capsule body 117 prior to firmly holding the capsule body 117 to the welding jig. After the capsule body 117 is held on the welding jig, the capsule lid 126, with the target biasing spring 123, is fully fitted into the open end of the body 117 prior to integrating the capsule lid 126 with the capsule body 117 into a single structure at the junction between the flange 125 of the lid 126 and the edge of the open end of the capsule body 117 through a plasma welding process or a TIG welding process. Therefore, it is possible to stably set the disc targets 116 in the form of point sources within the capsule body 117 while elastically holding the targets 116 by the spring 123 and preventing an undesirable movement of the targets 116 within the capsule body 117.

When the cap connector 109 of the source capsule 103 is connected to the first end of the pigtail 107 so as to make a desired radiation source assembly 101 of this invention, the first end of the pigtail 107 engages with the cap connector 109 through a thread engagement. In such a case, the internal round threads 119 formed on the inside wall of the pigtail fitting hole 115 of the cap connector 109 act as a guide passage for the large-diameter coil 129 of the pigtail 107.

After the cap connector 109 engages with the first end of the pigtail 107 through a thread engagement, the cap connector 109 is compressed at its external surface by the connector press of this invention, thus being compression-locked to the first end of the pigtail 107.

In the same manner as that described for the cap connector 109, the second end of the pigtail 107 primarily engages with the female connector 105 through a thread engagement in order to connect the female connector 105 to the second end of the pigtail 107. In such a case, the internal round threads 120 formed on the inside wall of the pigtail fitting hole 114 of the female connector 105 act as a guide passage for the large-diameter coil 129 of the pigtail 107. After the female connector 105 engages with the second end of the pigtail 107, the female connector 105 is compressed at its external surface by the connector press of this invention, thus being compression-locked to the second end of the pigtail 107.

In the radiation source assembly 101 of this invention, the disc targets 116 are stably set within the capsule body 117 while being elastically held by the spring 123 of the capsule lid 126 and being prevented from an undesirable movement within the capsule body 117. The disc targets 116 thus maintain desired states of point sources regardless of the number of targets 116 during a nondestructive inspecting operation, and so it is possible for the targets 116 to provide a high quality nondestructive inspection image with a precise focusing on an object.

In addition, a device for biasing the capsule lid 126 is provided on the dedicated welding jig for allowing the capsule lid 126 to be welded to the capsule body 117 while maintaining the disc targets 116 in the states of point sources. It is thus possible to improve the weldability of the inside capsule 113.

Figure 10:
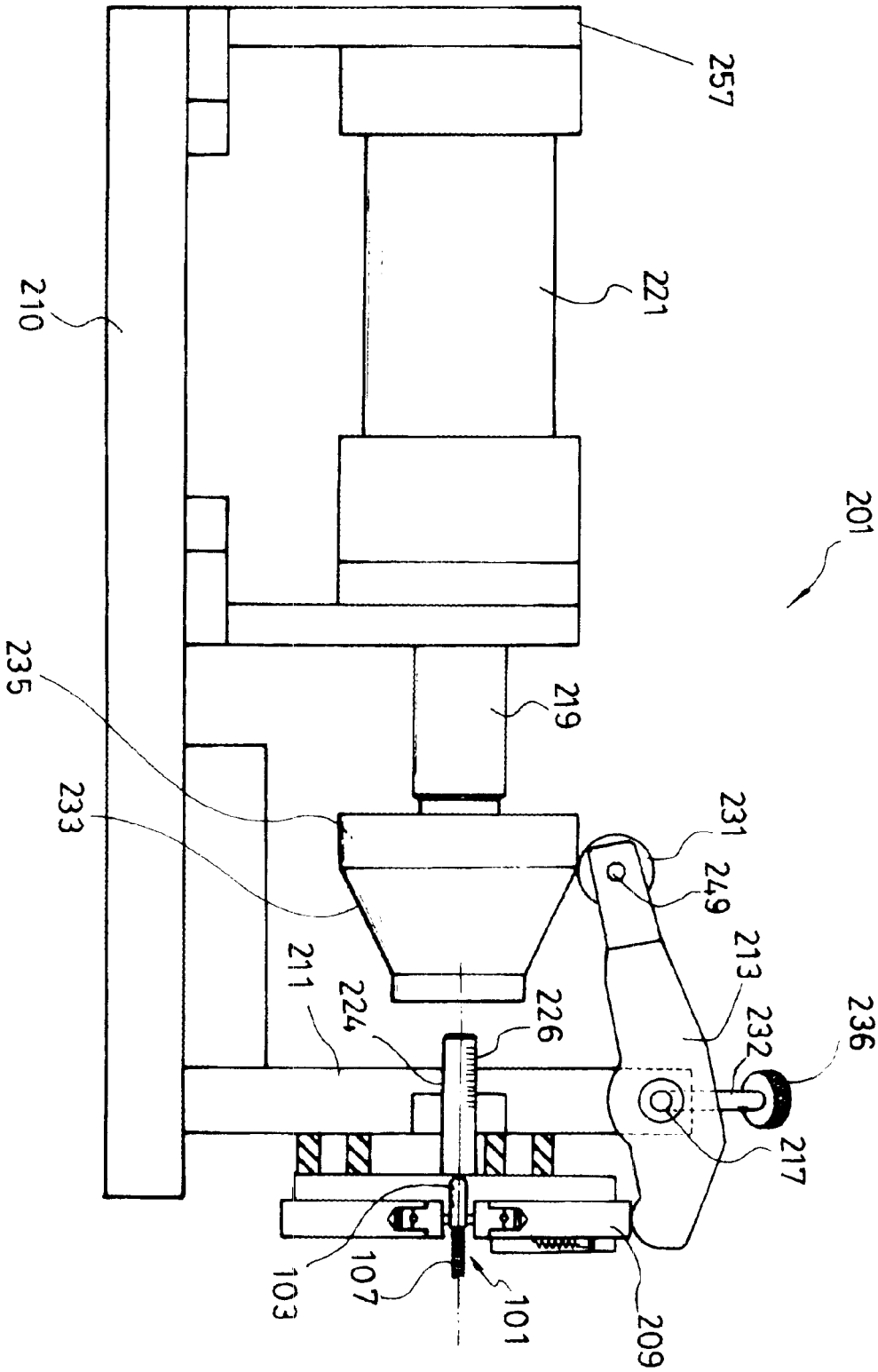
FIG. 10 is a front view, showing the construction of a connector press used for producing the assembly of this invention.
Figure 11:
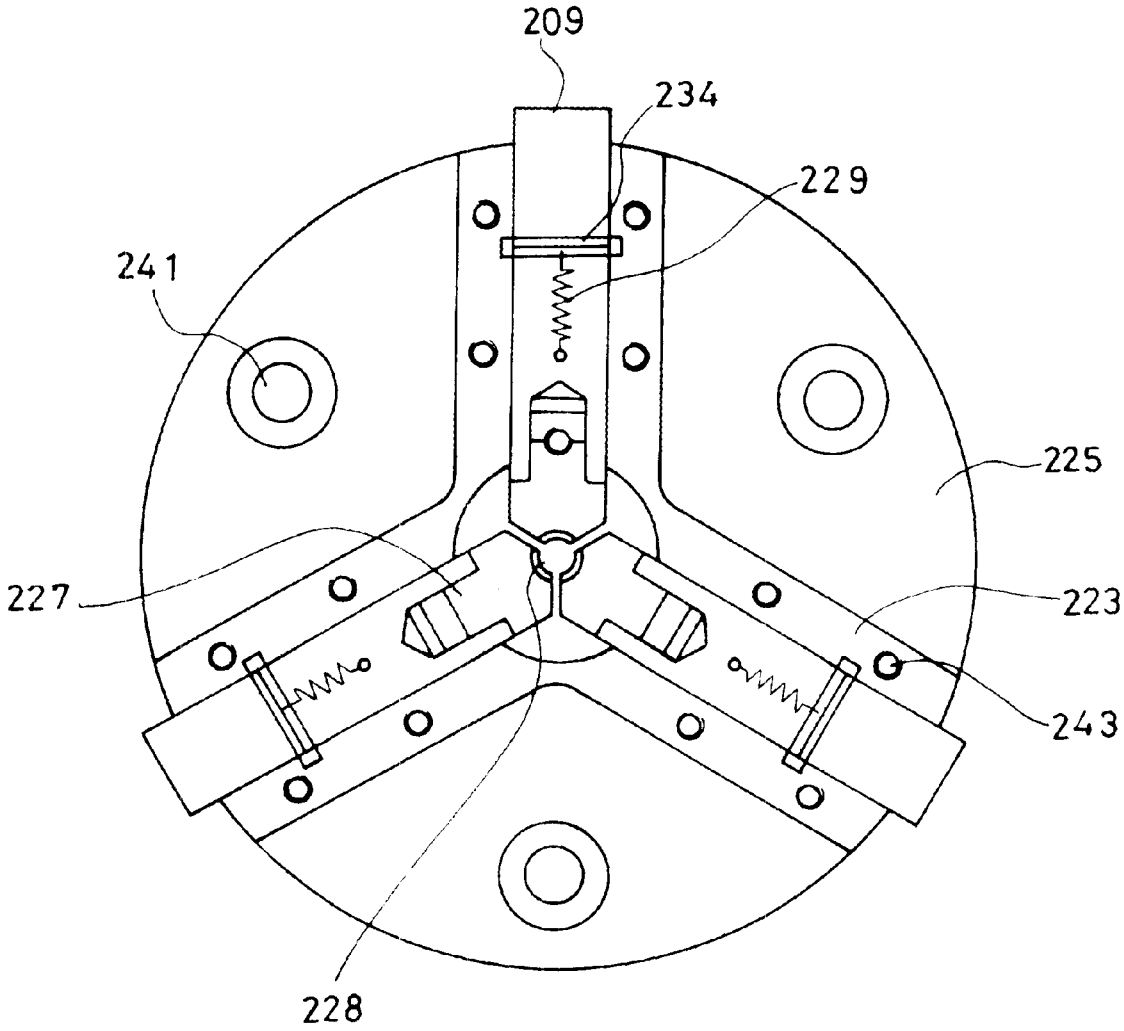
FIG. 11 is a front view of a triple-point compression punch unit included in the press of FIG. 10.
Figure 12:
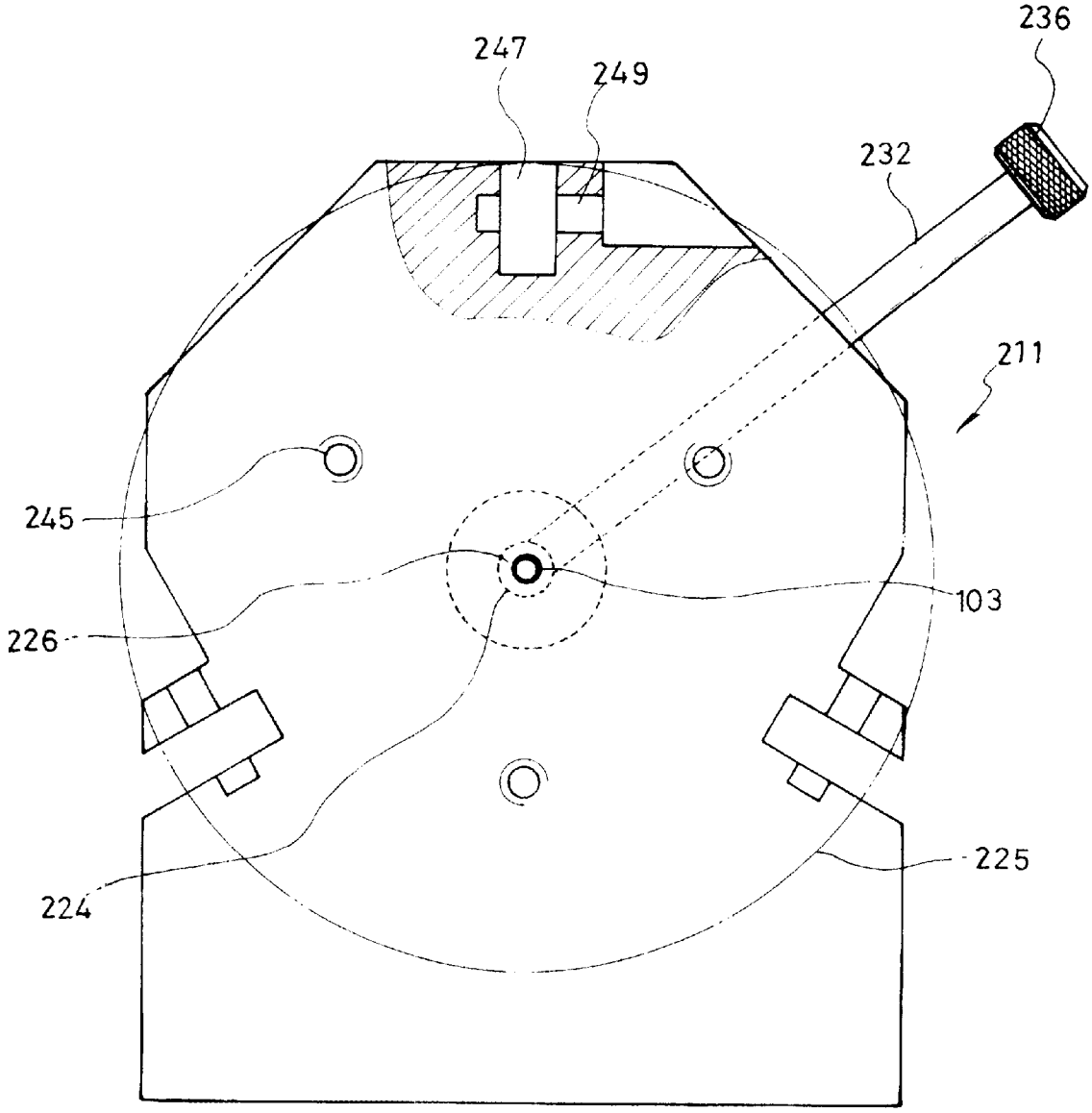
FIG. 12 is a front view of a support included in the press of FIG. 10.

FIGS. 10 to 12 show the construction of a connector press 201 used for producing the radiation source assemblies 101 of this invention. As shown in the drawings, the connector press 201 accomplishes a desired compression locking of the source capsule 103, enclosing the radiation source disc targets 116, to the elastic pigtail 107 by simultaneously compressing the capsule 103 at regularly and angularly spaced points through a multi-point compressing process, thus producing a desired radiation source assembly 101. In the preferred embodiment shown in the drawings, the connector press 201 is a triple-point press as an example.

The connector press 201 comprises a base 210, with a plurality of compression punches 209, a drive cylinder actuator 221, a push rod 219 and a plurality of pressure rods 213 being installed on the base 210. In the connector press 201, the compression punches 209 compress the source capsule 103 against the pigtail 107 of the assembly 101. The drive cylinder actuator 221 generates a drive force which is supplied to the compression punches 209. The one push rod 219 and the several pressure rods 213 transmit the drive force of the actuator 221 to the compression punches 209 while converting the horizontal force of the actuator 221 into a vertical force for the punches 209.

The compression punches 209 are designed to compress the overlapped portion of the source capsule 103 fitted over the pigtail 107 at regularly and angularly spaced external points. In the embodiment of FIG. 11, three compression punches 209 are radially held on a punch holding disc 225 at regularly and angularly spaced positions, thus forming a triple-point compression punch unit. That is, the three compression punches 209 are regularly and radially positioned on the holding disc 225 while being spaced out at angular intervals of 120°. The punch holding disc 225 is fixed to a support 211 using a plurality of set bolts 241, with the support 211 being mounted on the base 210 of the press 201.

The three compression punches 209 are movably received within three radial guide channels of a guide member 223 in a way such that the punches 209 are radially reciprocable on the holding disc 225 under the guide of the guide channels. The above guide member 223 is mounted to the holding disc 225 using a plurality of set bolts 243 with the guide channels radially positioned on the disc 225. A compression tip 227, with a compression blade 228, is provided on the inside end of each compression punch 209. In such a case, the compression tip 227 is removably attached to the inside end of each punch 209, and so it is possible to selectively attach a compression tip 227, having a radius of curvature equal to the desired compressed radius of a source capsule 103, to the inside end of each punch 209. A transverse member 234 is fixed to each of the guide channels of the guide member 223 while passing across each guide channel at an upper position while being free from interfering with a radial movement of an associated compression punch 209. Each of the transverse members 234 is connected to an associated compression punch 209 by an extension coil spring 229, or a return spring, and so the punches 209 are automatically returned to their outside positions within the guide channels of the guide member 223 due to the restoring force of the return springs 229 when the external force is removed from the punches 209.

As shown in FIG. 12, the support 211, holding the punch holding disc 225, is a flat plate chamfered at its corners. A plurality of bolt holes 245 for the set bolts 241 are formed on the support 211 at regularly and angularly spaced positions on one circle. In order to rotatably hold the three pressure rods 213 for the three compression punches 209, the support 211 has three notches 247 on its outside edge at regularly spaced positions of an angular interval of 120°. A through hole 249 is perpendicularly formed on each of the notches 247, thus receiving a holding pin 251 rotatably holding an associated pressure rod 213 on the disc 225.

A central hole 224 is formed at the center of the support 211 and receives a scale rod 226 which supports the outside end of the source capsule 103 of a radiation source assembly 101, the assembly 101 being held by the inside ends of the three compression punches 209. In order to hold the scale rod 226 at a desired position within the support 211, an adjusting screw 232, used for adjusting a compressing target position, is radially inserted from one chamfered top corner into the center of the support 211. A knob 236 is mounted to the outside end of the adjusting screw 232, while the body of the rod 232 is externally threaded. Therefore, the radial position of the adjusting screw 232 relative to the support 211 is adjustable by rotating the knob 236 at the outside of the support 211, thus fixing or releasing the scale rod 226 within the support 211 as desired. As shown in FIG. 10, a graduation is formed on the external surface of the scale rod 226, thus allowing a person to see the inserted length of the assembly 101 at the outside of the press 201.

Figure 14:
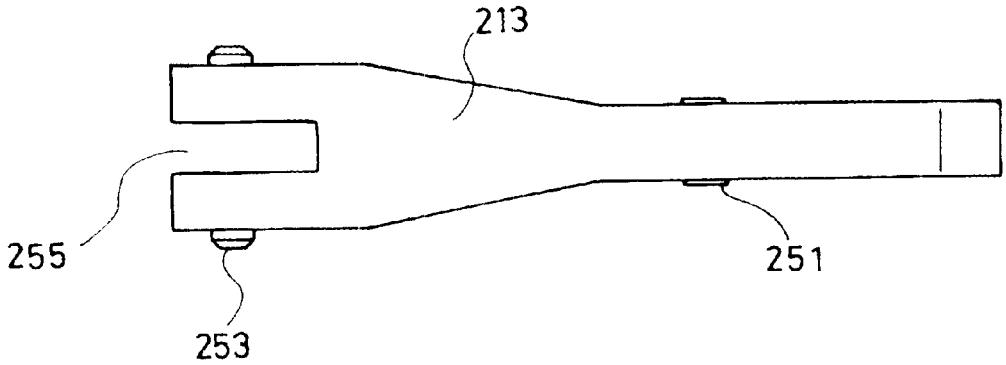
FIG. 14 is a plan view of a pressure rod included in the press of FIG. 10.

As shown in FIG. 10, the three pressure rods 213, inwardly pushing the compression punches 209 in a radial direction at the outside ends of the punches 209, are rotatably mounted to the notches 247 of the support 211 at their hinge points 217. The hinge point 217 of each pressure rod 213 is positioned at about ⅓ of the total length from the front end, or the punch pushing end of the pressure rod 213. The rear end of each pressure rod 213 is provided with a roller 231. The above roller 231 is set within a roller seat slit 255 formed on the rear end of the pressure rod 213 and is rotatably held within the slit 255 by a pin 253 as shown in FIGS. 10 and 14.

A push block 235, coming into contact with the rollers 231 of the pressure rods 213, is a truncated conical member, with an inclined surface 233 at which the rollers 231 commonly come into movable contact with the block 235. The above push block 235 is axially moved by the drive force of the actuator 221, thus rotating the pressure rods 213 around the holding pins 251 mounted at the hinge points 217 of the pressure rods 213. The pressure rods 213 are thus opened or closed at their punch pushing ends. The push block 235 is connected to the actuator 221 through the push rod 219.

The reciprocable push rod 219 is mounted to the cylinder actuator 221 and axially reciprocates by the drive force of the actuator 221, thus allowing the rollers 231 of the pressure rods 213 to be moved along the inclined surface 233 of the push block 235. The cylinder actuator 221 is horizontally installed on the base 210 by a support frame 257.

The operational effect of the above connector press 201 while producing a radiation source assembly 101 will be described hereinbelow.

Prior to a compression-locking process performed by the press 201, a source capsule 103, with a plurality of radiation source disc targets 116, engages with the first end of a pigtail 107. In such a case, the first end of the pigtail 107 may engage with the capsule 103 through a forcible fitting process or through a thread engagement in accordance with the kind of a desired assembly 101.

Figure 13:
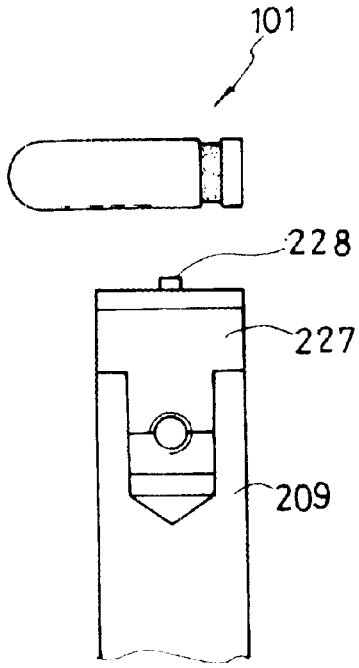
FIG. 13 is a side view, showing a compression punch of the press of FIG. 10 and a source capsule of a radiation source assembly to be compression-locked to a pigtail by the compression punch.

After the source capsule 103 primarily engages with the first end of the pigtail 107, the assembly 101 is carefully positioned within the connector press 201 in a way such that the overlapped portion of the capsule 103 engaging with the pigtail 107 is precisely positioned within the center of the radially arranged compression punches 209 as shown in FIG. 10. The position of the assembly 101 relative to the three compression punches 209 is best seen in FIG. 13. When the position of the assembly 101 relative to the punches 209 is set, the adjusting screw 232 is loosened prior to carefully moving the scale rod 226 to the left or right until the position of the scale rod 226 is completely adjusted to accomplish a desired depth corresponding to the determined compressing target position. Thereafter, the adjusting screw 232 is tightened, thus fixing the adjusted position of the scale rod 226. When the adjusted position of the scale rod 226 is fixed as described above, it is possible to precisely set the compressing target position of the source capsule 103 which is to be compressed by the compression blades 228 of the tips 227 of the three punches 209.

When the radiation source assembly 101 is completely set within the press 201, the cylinder actuator 221 is turned on, thus axially moving the push rod 219 along with the push block 235 toward the support 211. Due to such a movement of the push block 235 toward the support 211, the rollers 231 of the pressure rods 213 simultaneously roll up along the inclined surface 233 of the truncated conical push block 235.

When the rollers 231 of the pressure rods 213 roll upwardly along the inclined surface 233 of the push block 235, the three pressure rods 213 are rotated clockwise around the hinge points 217 in FIG. 10. Therefore, each of the three pressure rods 213 inwardly biases an associated one of the three compression punches 209 in a radial direction of the holding disc 225 with a force stronger than that applied to the roller 231 three times due to a leverage effect.

In such a case, the three compression punches 209 move radially and inwardly at the same time under the guide of the guide channels of the guide member 223 shown in FIG. 11, thus synchronously compressing the target portion of the source capsule 103 by their compression blades 228 at three points.

After the compression locking process performed by the three punches 209, the push rod 219 moves toward the cylinder actuator 221, thus returning to its original position. In such a case, the push block 235,also returns to its original position while allowing the rollers 231 of the pressure rods 213 to roll down along the inclined surface 233 of the push block 235. Therefore, the pressure rods 213 are rotated counterclockwise around the hinge points 217 in FIG. 10, thus removing the biasing force from the three compression punches 209. Therefore, the compression punches 209 automatically move outwardly in the radial direction by the restoring force of the return springs 229, thereby allowing the assembly 101 to be removed from the press 201.

As described above, the present invention provides a radiation source assembly. In the assembly, the cap connector of a radiation source capsule and the female connector engaging with the male connector of a manipulation handle are each provided with internal round threads on its pigtail fitting hole. Each of the two connectors thus engages with the large-diameter coil of the pigtail at the internal round threads through a thread engagement prior to being compressed at a target portion by a plurality of compression punches of a connector press. Therefore, the two connectors, which are threaded with and compression-locked to both ends of the pigtail, are almost completely prevented from an unexpected removal from the pigtail different from a conventional assembly wherein the two connectors engage with the pigtail through a forcible fitting engagement prior to being compression-locked to the pigtail. In addition, the radiation source assembly of this invention allows a person to know whether both ends of the pigtail fully reach desired points within the two connectors, thus securing a precise compressing target portion. In the assembly of this invention, the inserted lengths of the pigtail relative to the two connectors are maximized, thus accomplishing a desired linearity of the assembly. Therefore, it is thus possible for a user to precisely, appropriately and safely use the radiation source assembly of this invention during a nondestructive inspecting operation. In addition, the assembly of this invention effectively minimizes the frictional resistance generated at the source capsule when the capsule repeatedly moves within a guide tube in opposite directions. The assembly is thus almost completely free from an operational error or being abrasion-damaged, or an unexpected radioactive contamination.

The present invention also secures a uniform length of the radiation source assemblies, thus allowing the assemblies to be precisely and firmly installed at desired positions within nondestructive inspecting apparatuses or within dedicated carriers. This finally and effectively reduces a radiation leakage from the assembly.

In the radiation source assembly of this invention, a target biasing spring is provided on the capsule lid for allowing the disc targets within the inside capsule of the source capsule to effectively maintain a desired condition as point sources regardless of the number of targets, with the capsule lid being fitted into and welded to a capsule body of the inside capsule. Therefore, the assembly of this invention provides a high quality nondestructive inspection image with a precise focusing on an object. In addition, a capsule lid biasing device is provided on a dedicated welding jig of this invention for allowing the capsule lid to be welded to the capsule body of the inside capsule while being biased by the device. Therefore, it is possible to prevent inert gas from being undesirably introduced into the inside capsule through the junction between the capsule body and the capsule lid during a TIG welding process performed in an inert gas atmosphere. This finally accomplishes a welding process for the inside capsule of the source capsule while maintaining the disc targets in the states of point sources and improves the weldability of the source capsule.

The present invention also provides a connector press used in producing the radiation source assemblies. The connector press of this invention accomplishes a desired compression locking of the source capsule to the elastic pigtail by simultaneously compressing the capsule at regularly and angularly spaced points through a multi-point compressing process. The connector press of this invention thus applies a uniform compressing force to the compressing target portion of the capsule engaging with the pigtail, and so the press accomplishes a desired linearity of the capsule and the pigtail.

Therefore, when the assembly of this invention is used in a nondestructive inspecting operation with the source capsule repeatedly moving within a radiation shield guide tube in opposite directions, the assembly is free from being exceedingly bent at the compression-locked portion. This finally prevents the assembly from causing an operational error or being abrasion-damaged due to a frictional resistance generated at such a bent portion, thus accomplishing a desired operational safety of the assembly.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A radiation source assembly, comprising a source capsule enclosing a radiation source, a female connector connected to a male connector, and a pigtail connecting the source capsule and the female connector together, wherein a cap connector of said source capsule has first internal threads on its pigtail fitting hole, with said first internal threads having a profile corresponding to a large-diameter coil of said pigtail and engaging with the large-diameter coil of a first end of the pigtail through a thread engagement.

2. The radiation source assembly according to claim 1, wherein said female connector has second internal threads on its pigtail fitting hole, with said second internal threads having a profile corresponding to said large-diameter coil of the pigtail and engaging with the large-diameter coil of a second end of the pigtail through a thread engagement.

3. The radiation source assembly according to claim 2, wherein the number of each of said first and second internal threads is four or more.

4. The radiation source assembly according to claim 1, wherein the number of said first internal threads is four or more.

5. A radiation source assembly, comprising:

a capsule body receiving stacked radiation source disc targets;

a capsule lid fitted into an open end of said capsule body and welded to said capsule body, thus sealing the capsule body; and a coil spring set within a spring seat hole of said capsule lid and adapted to normally bias the radiation source disc targets within the capsule body in a direction after the capsule lid is welded to the capsule body.

* * * * *